US005332026A

United States Patent [19]

Thieman et al.

[11] Patent Number: 5,332,026

[45] Date of Patent: Jul. 26, 1994

[54] PRODUCTION OF COPPER DIE CAST ROTORS FOR ELECTRIC MOTORS

[75] Inventors: Ted H. Thieman; Richard J. Kamm, both of Dayton, Ohio

[73] Assignee: THT Presses Inc., Dayton, Ohio

[21] Appl. No.: 951,804

[22] Filed: Sep. 28, 1992

[51] Int. Cl.[5] ..... B22D 17/12; B22D 19/00

[52] U.S. Cl. ..... 164/493; 164/109; 164/113; 164/312; 164/333; 164/335; 164/513

[58] Field of Search ..... 164/109, 113, DIG. 10, 164/312, 333, 332, 335, 483, 513

[56] References Cited

U.S. PATENT DOCUMENTS

| | | | |
|---|---|---|---|
| 2,265,333 | 12/1941 | Wry | 164/109 X |
| 2,607,969 | 8/1952 | Evans et al. . | |
| 2,917,797 | 12/1959 | Poughnand | 164/513 |
| 2,938,250 | 5/1960 | Larsh et al. | 164/DIG. 10 X |
| 2,991,518 | 7/1961 | Schaefer . | |
| 3,315,315 | 4/1967 | Triulzi | 164/113 X |
| 3,584,345 | 6/1971 | Beastrom | 164/109 X |
| 3,826,302 | 7/1974 | Wunder | 164/343 X |

FOREIGN PATENT DOCUMENTS

| | | | |
|---|---|---|---|
| 4-172162 | 6/1992 | Japan | 164/113 |

*Primary Examiner*—J. Reed Batten, Jr.

*Attorney, Agent, or Firm*—Jacox & Meckstroth

[57] ABSTRACT

An ingot having a predetermined amount of electrolytic copper and a small percentage of boron copper alloy is rapidly heated to about 2,100° F. in a clay graphite crucible by induction coils surrounding the crucible. The crucible and the entire amount of molten copper are automatically transferred to a cavity defined within a shot cylinder above a vertically movable shot piston of a vertical die casting press. A shuttle moves a lower end ring mold and a stack of connected rotor laminations into a position above the shot cylinder, and the press moves an upper end ring mold downwardly to clamp the stack between the molds and against the cylinder. The molten copper is rapidly injected upwardly through gates within the lower mold and into end ring cavities within the molds and also through connecting aligned bar slots within the stack of laminations with a shot pressure of about 2250 psi. After the copper solidifies by circulating cooling water within the molds, the press opens and the die cast rotor and lower mold are transferred by the shuttle to a position where the rotor is ejected upwardly from the lower mold by a fluid cylinder. The copper rotor is annealed by induction heating the rotor to about 1,500° F. and allowed to air cool.

15 Claims, 2 Drawing Sheets

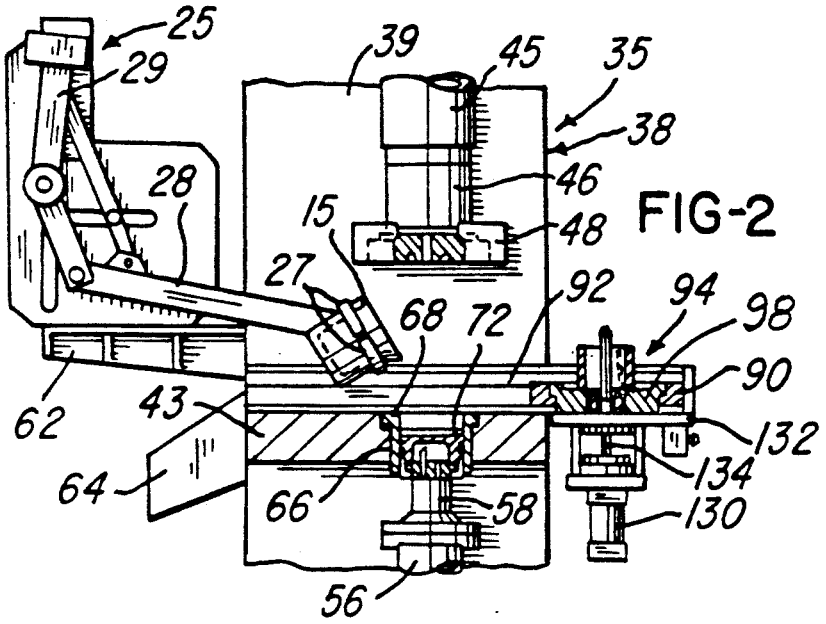
FIG-2
FIG-3
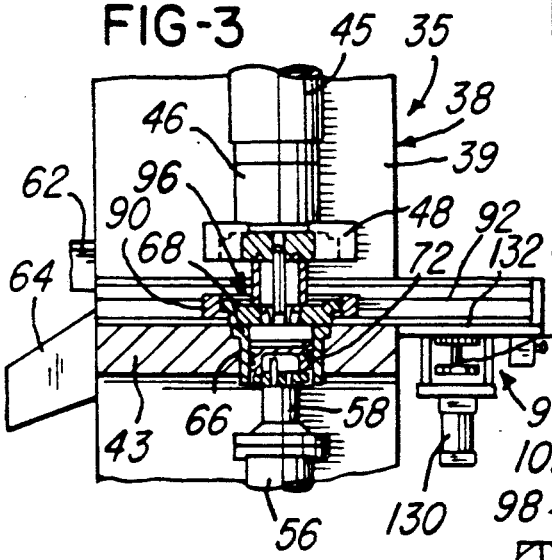
FIG-4
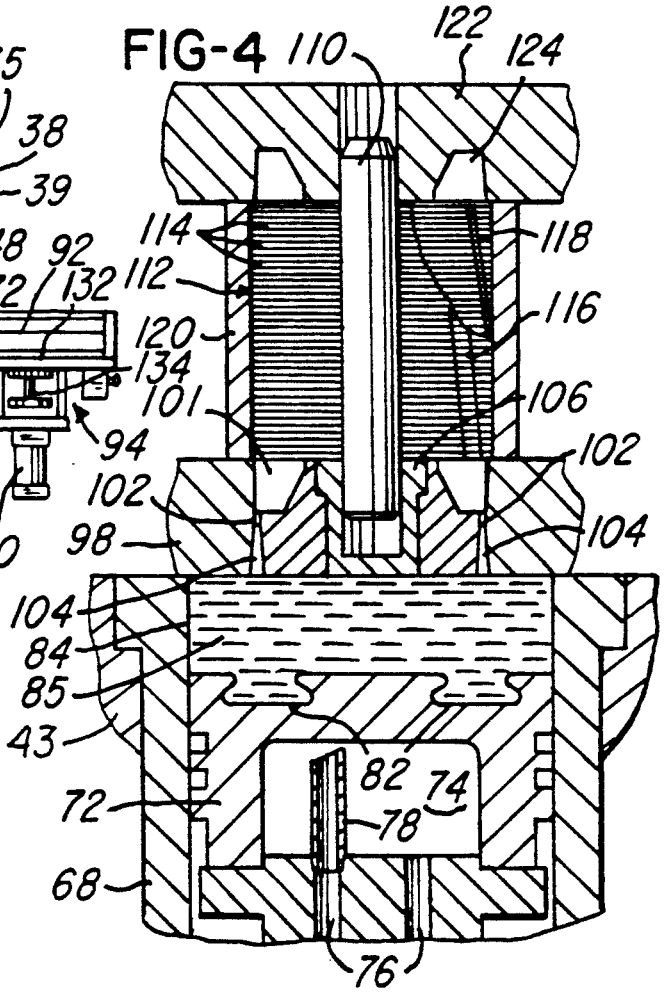

PRODUCTION OF COPPER DIE CAST ROTORS FOR ELECTRIC MOTORS

BACKGROUND OF THE INVENTION

In the production of die cast rotors for electric motors, it is common to position a stack of steel rotor laminations between a set of molds which define cavities for producing end rings on opposite ends of the lamination stack. The stack of laminations are secured together, for example, by welding or a pressed-in arbor or by interlocking adjacent laminations at the stamping press. Each mold may define a single cavity for producing a single die cast rotor or may define multiple cavities for simultaneously producing a plurality of rotors. The laminations within each stack are provided with peripherally spaced openings or slots through which die cast material flows from one end ring mold to the opposite end ring mold for casting internal bars which integrally connect the cast end rings. When the rotor laminations have peripherally spaced slots extending to the outer surface of the lamination stack, a cylindrical casting mold or retainer surrounds the lamination stack to confine the die cast material as it is forced through the slots to form the end rings and connecting bars.

After the assembly of the lamination stack, surrounding retainer and end ring molds is clamped within a die cast machine or press, the preheated die casting material, which is commonly aluminum, is injected into one of the molds for filling the end ring cavities within the molds and for filling the circumferentially spaced slots within the lamination stack. After the cast aluminum solidifies in response to a flow of cooling water through holes within the molds, the press is opened and the aluminum die cast rotor is removed from the press.

Preferably, die cast rotors are produced in a vertical die cast press, for example, of the type manufactured by THT Presses Inc., the assignee of the present invention. When this vertical die cast press is used to produce aluminum die cast rotors, an electrical resistance furnace is used to heat a volume or vat of aluminum sufficient to produce a large number of aluminum die cast rotors. During each cycle of the press, an automatic ladle dips down into the vat of molten aluminum and transfers a batch of aluminum to a cavity defined within the top portion of a cylindrical shot sleeve enclosing a vertically movable and hydraulically actuated shot piston.

After the ladle is removed from the press, the lamination stack and the lower end ring mold are moved into the press by a shuttle, and the upper end ring mold is moved downwardly by the press on top of the stack to clamp the assembly of the molds and stack against the shot sleeve. The molten aluminum is then forced upwardly through gates within the lower end ring mold by upward movement of the shot piston. The molten aluminum flows upwardly into and through the end ring cavity within the lower mold, through the bar slots within the lamination stack and into the end ring cavity within the upper mold. After the aluminum has solidified, the press is opened which raises the upper end ring mold. The lower end ring mold and die cast rotor are then shifted laterally out of the press by the shuttle to a position where the die cast rotor is ejected upwardly from the lower mold by a fluid cylinder.

When a rotor is die cast with aluminum, the electrical conductivity of the rotor cage is usually no more than 62% IACS (International Annealed Copper Standards).

This limits the current density within the aluminum conductor bars extending within the lamination slots and connecting the die cast end rings. This electrical conductivity limitation affects conductor bar size, maximum conductor bar current due to heating and overall rotor efficiency.

It is well known that if a die cast rotor could be produced using copper in place of aluminum, the higher conductivity of copper could produce a more efficient rotor for an electric motor. For example, U.S. Pat. Nos. 2,607,969 and 2,991,518 mention that die cast rotors may be produced with a conducting metal such as copper, aluminum, etc. However, these patents do not recognize the unusual problems associated with die casting copper to form a rotor for an electric motor. For example, copper has a melting temperature of about 1980° F. as compared to about 1220° F. for aluminum. Copper also has a density of about three times greater than aluminum and rapidly absorbs oxygen and hydrogen which reduce conductivity and produce unacceptable cracking in a copper cast rotor.

SUMMARY OF THE INVENTION

The present invention is directed to an improved method and apparatus for effectively producing die cast copper rotors which significantly increase the efficiency of electric motors by increasing the rotor cage electrical conductivity to within a range of 95% to 100% IACS. According to a preferred embodiment of the invention, this increase in the electrical conductivity is obtained by preparing an ingot of electrolytic copper or oxygen-free, high conductivity (OFHC) copper and adding to the copper ingot a master alloy of 2% boron copper (2% BCu) to result in an ingot composition of about 90% copper and 10% boron copper. This ingot of copper material is placed in a clay graphite crucible and is heated in an induction furnace with induction coil heaters which surround the crucible. The amount of copper/boron copper melted in the crucible is the same amount to be poured into the injection cylinder or shot sleeve of a vertical die cast press of the type described above.

The clay graphite crucible is transferred from the induction coils to the press by an automatic transfer mechanism. As a result, the melt time for the copper material and the time that the copper material is in a molten state is minimized, thereby minimizing the absorption of oxygen and hydrogen by the molten copper material. Preferably, the total melt and hold time does not exceed ten minutes. The copper material is forced rapidly into the end ring molds and slots within the lamination stack with a substantial pressure of about 2100 psi. After the copper material is injected and cooled to solidify within the molds, the die cast rotor is removed from the molds and heated by induction heating to approximately 1500° F. and allowed to air cool. This heat treatment anneals the copper and further improves the electrical conductivity of the die cast end rings and connecting bars extending through the lamination stack.

Other features and advantages of the invention will be apparent from the following description, the accompanying drawing and the appended claims.

BRIEF DESCRIPTION OF THE DRAWINGS

FIG. 2 is a fragmentary section of the press and illustrating how the copper material is poured from a transferred crucible within which the copper material is melted;

FIG. 3 is another fragmentary section of the press shown in FIGS. 1 and 2 and with the press in a closed position; and FIG. 4 is an enlarged vertical section of portions of the press and the molds shown in FIG. 3, and illustrating the injection of the copper material into cavities within the end ring molds and bar slots within the lamination stack.

DESCRIPTION OF THE PREFERRED EMBODIMENT

Figure 1:
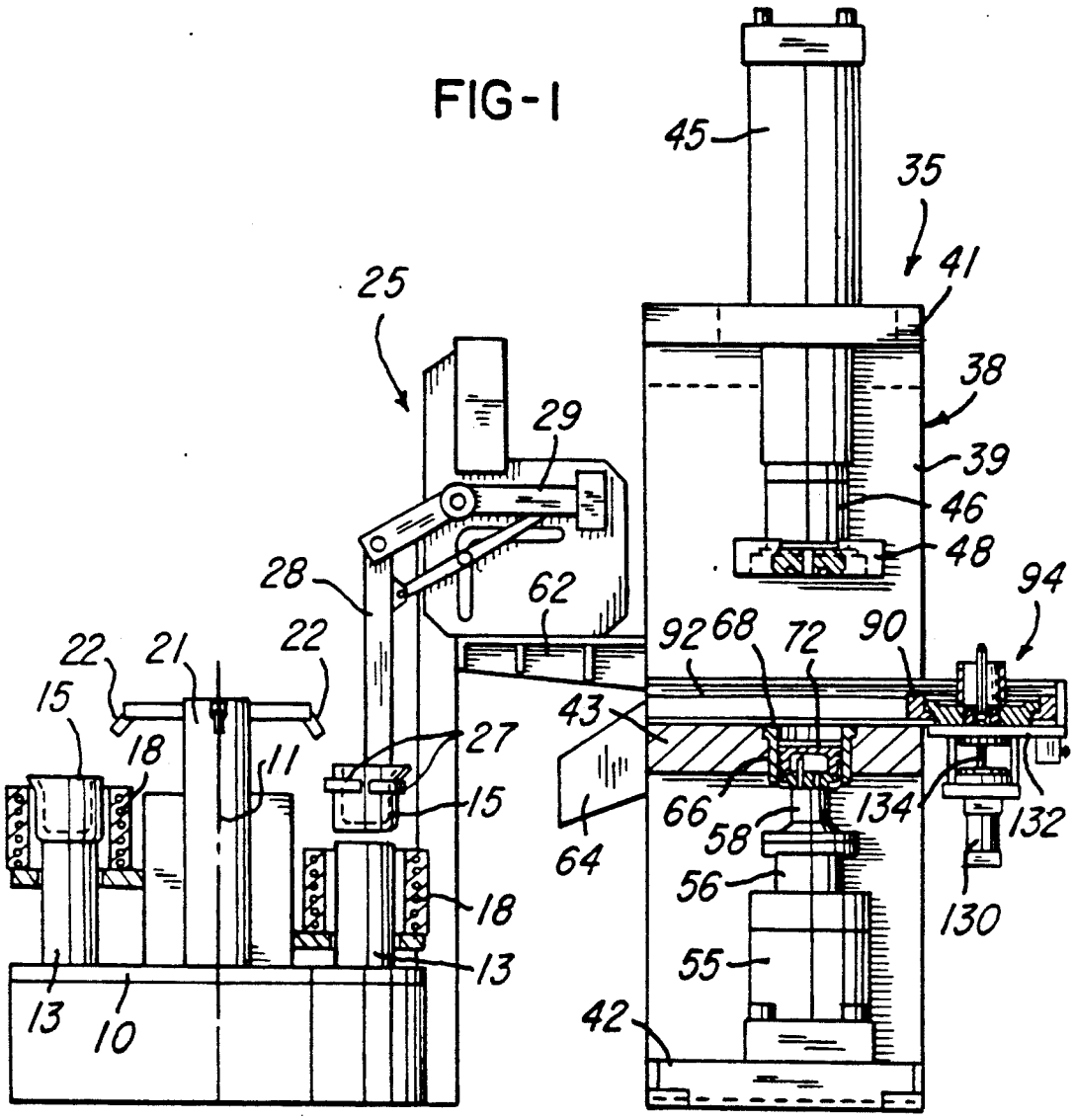
FIG. 1 is an elevational view of an induction furnace, automatic transfer mechanism and vertical die cast press constructed and assembled in accordance with the invention and with portions of the press shown in sect7230 ion.

FIGS. 1–4 illustrate apparatus and method for producing a die cast motor rotor in accordance with the invention and wherein a circular table 10 within an induction furnace is supported for indexing on a vertical axis 11. The table carries a set of four uniformly spaced pedestals 13 each of which supports a clay graphite crucible 15. One make of crucible which has provided satisfactory results is produced by Ferro Corporation in Buffalo, N.Y. and sold as the Model CG-35. This crucible is formed of clay bonded graphite and silicon carbide and has an electrical resistivity of 0.17 ohm-cm at room temperature. The table 10 also supports an annular induction electrical heating coil 18 for each pedestal 13, and each coil is supported for vertical movement between an upper position surrounding primarily the corresponding crucible 15 and a lower retracted position surrounding the pedestal 13.

An ingot (not shown) of electrolytic copper or oxygen-free, high conductivity copper, is placed within each crucible 15 at a loading station. Each ingot also includes a master alloy of 2% boron copper to provide an ingot composition of about 90% copper and 10% boron copper. The amount of such copper material placed in each crucible 15 is the same amount which is to be poured from the crucible into a die casting machine or press, as will be explained later. The indexing table 10 also has a center post 21 which carries an optical pyrometer 22 for each crucible 15 in order to monitor the temperature of the copper material within each crucible.

After the predetermined amount of copper material is induction heated within each crucible 15 to about 2100° F., but not over 2175° F., the table 10 is indexed to position the crucible 15 and molten copper material at a transfer station where the corresponding induction heating coil 18 is retracted downwardly to expose the crucible 15 containing the molten copper material. At this station, an automatic transfer mechanism 25 is positioned to grip the crucible 15 by means of movable or pivotal gripping fingers 27 carried by an arm 28 pivotally connected to a rotatable arm 29. One form of automatic transfer mechanism 25 which is capable of providing satisfactory results and illustrated in FIG. 1, is constructed by modifying a 906 Series Automatic Ladle unit produced by Snair Co. in Hilliard, Ohio. The unit is modified by replacing the ladle with a pair of the opposing fluid actuated gripping fingers 27 which open and close to grip and release a crucible 15.

The automatic transfer mechanism 25 transfers each crucible 15 and the molten charge or volume of copper material to a vertical die casting machine or press 35 such as the "THT" Vertical Die Cast Press mentioned above and produced by THT Presses Inc., the assignee of the present invention. The vertical die cast press 35 is a 100 ton vertical die cast press which includes a vertical frame 38 having parallel spaced vertical side walls 39 rigidly connected by an upper wall or plate 41, a lower or bottom wall or plate 42 and an intermediate wall or bed plate 43. A hydraulic cylinder 45 is supported by the top plate 41 and includes a downwardly projecting piston rod or ram 46 supporting an inverted cup-shaped top clamp member 48. The lower plate 42 supports another hydraulic cylinder 55 having an upwardly projecting piston rod or ram 56 on which is mounted a ram extension member 58. An arm or bracket 62 projects outwardly from one of the press side walls 39 and supports the automatic transfer mechanism 25 which includes the arms 28 and 29 and the crucible gripping fingers 27. A chute 64 projects downwardly from the bed plate 43 for directing residual casting material into a container (not shown), as will be explained later.

The intermediate bed plate 43 has a cylindrical stepped bore 66 which receives a shot or injection cylinder or sleeve 68 which is preferably formed of molybdenum alloy. The sleeve 68 (FIG. 4) encloses a vertically movable shot piston 72 which is also preferably formed of molybdenum alloy and mounts on top of the ram extension 58. The piston 72 defines a bottom cavity 74, and a set of passages 76 are formed within the ram extension member 58 for circulating cooling water through the cavity 74. A water inlet tube 78 extends from the member 58 into the cavity 74 for directing the cooling water against the inner surface of the piston 72 for quickly conducting heat from the piston. A pair of tapered dove-tail slots 82 are formed within the top surface of the shot piston 72, and this surface cooperates with the inner cylindrical surface of the shot sleeve 68 to define a shot cavity 84 for receiving molten copper material 85.

Referring to FIG. 1, a shuttle table 90 is supported for horizontal movement by a pair of parallel spaced tracks 92 supported by the bed plate 43. The shuttle table 90 is movable in response to actuation to a fluid cylinder (not shown) between a loading and unloading station 94 (FIG. 1) and an injecting station 96 (FIG. 3) where the shuttle table 90 is positioned directly above the shot sleeve 68. The shuttle table 90 has a stepped bore which receives a lower end ring mold 98 (FIGS. 1 & 4), and the lower mold 98 defines an annular end ring cavity 101 (FIG. 4). The outer portion of the cavity 101 is connected by a series of peripherally spaced gates 102 to corresponding tapered sprue passages 104 which are open at the bottom surface of the mold 98.

A cup-shaped bushing 106 (FIG. 4) is mounted within the center of the lower mold 98 and receives the lower end portion of a cylindrical arbor 110 on which is press-fitted a stack 112 of steel rotor laminations 114. In a conventional manner, the stack 112 of laminations 114 define peripherally spaced bar slots 116, and each slot 116 is connected by a narrower slot 118 to the outer surfaces of the laminations 114. The slots 116 may extend axially through the lamination stack 112 or they may be slightly skewed, as shown in FIG. 4. A retaining mold or sleeve 120 surrounds the lamination stack 112 and extends from the lower mold 98 to an upper mold 122 which is secured to the upper ram 46 within the surrounding clamp member 48.

The upper mold 122 defines an annular upper end ring cavity 124, and the cavities 101 and 124 are connected by the slots 116 within the lamination stack 112. As shown in FIG. 1, the upper end ring mold 122 is carried by the ram 46 of the hydraulic cylinder 45 and moves vertically with the ram between a retracted upper position (FIG. 1) and a lower clamp position (FIG. 3) when the assembly of the molds 98 and 122 and retaining sleeve 120 are clamped against the shot sleeve 68 with the arbor 110 and lamination stack 112 confined within the sleeve 120. As shown in FIGS. 1–3, a hydraulic cylinder 130 is supported by bracket 132 mounted on the press frame 38, and the cylinder 130 has a piston rod 134 which vertically aligns with the bushing 106 and arbor 110 when the lower mold 98 is moved to the station 94 by the shuttle table 90.

The apparatus described above in connection with FIGS. 1–4 is used in accordance with the invention for producing a copper die cast rotor by placing a copper ingot of predetermined volume within a crucible 15. The ingot used is electrolytic copper or oxygen-free, high conductivity copper mixed with a master alloy of 2% boron copper to provide a resulting composition of about 90% electrolytic copper and 10% boron copper. This combined copper material is heated in the crucible by energizing the corresponding induction coils 18 so that the melt time is minimized in order to minimize the time that the copper material is in a molded state and thereby minimize the oxygen and hydrogen content of the material. The total melt and hold time should not exceed ten minutes, and the amount of copper material heated within the crucible should be the same amount required for charging the one or more copper rotors during each cycle of the die cast operation.

The electrolytic copper has an electrical conductivity of 102% IACS, and the 2% boron copper has an electrical conductivity of 35% IACS. Using the above melt procedure produces a molten copper material with an electrical conductivity greater than 100% IACS. Preferably, the copper material is melted at a temperature of about 2100° F., and the temperature should not exceed 2175° F. Melt samples produced by the above melting procedure have a Rockwell hardness on the "F" scale of between 45 and 50.

As illustrated in FIGS. 1 and 2, after the induction heating of the copper material within a crucible 15 and the material becomes molten, the crucible 15 is gripped by the fingers 27 of the transfer mechanism 25 and the crucible is moved into the press (FIG. 2) where the molten copper material is poured into the cavity 84 defined by the shot sleeve 68 to form the molten copper charge or shot 85 (FIG. 4). While the empty crucible 15 is being retracted from the press, the assembly of the lower mold 98 and retainer sleeve 120 confining the lamination stack 112, is moved by the shuttle table 90 to the injecting station 96 where the assembly is located directly above the shot sleeve 68 (FIG. 4). The hydraulic cylinder 55 is then provided with a shot pressure of about 2250 psi which moves the shot piston upwardly to force the copper material 85 upwardly through the sprue passages 104 and gates 102 into the end ring cavities 101 and 124 and the connecting bar slots 116. Preferably, the injection rate of the copper material through the gates 102 is at a rate of about 1250 cubic inches per second which results in a velocity of the copper through the gates 102 of between 2000 and 2200 inches per second.

After the end ring cavities 101 and 124 and bar slots 116 are filled, the copper material is cooled by circulating water through passages (not shown) within the upper and lower molds. The upper mold 122 is then elevated with the ram 46, and the shot piston 72 is retracted downwardly to remove the sprues from the mold 98. The die cast rotor and retaining sleeve 120 are then shifted with the lower mold 98 by the shuttle table 90 to the ejecting position or unloading station 94. While the shuttle table 90 is being moved to the station 94, the shot piston is elevated until the bottom of the dovetail grooves 82 is flush with the top of the bed plate 43. A portion of the shuttle table 90 is then shifted back to the left by a hydraulic cylinder (not shown) for ejecting the sprues and connecting base or "bisket" from the shot piston to the discharge chute 64. The hydraulic cylinder 130 is then actuated to press the die cast rotor and bushing 106 upwardly by about ½ inch to release the rotor from the lower mold 98. After the sleeve 120 is pressed or removed from the copper die cast rotor, the rotor is heat treated by induction heating the rotor to about 1500° F. and allowed to air cool. This heat treatment anneals the copper and significantly improves the electrical conductivity of the end rings and connecting bars from about 87% IACS to 95% IACS.

From the drawings and the above description, it is apparent that the production of a copper die cast rotor using the method and apparatus of the present invention, provides desirable features and advantages. In general, the method and apparatus of the invention produces an electric motor rotor having a high conductivity on the order of 90% to 100% IACS and with the cast copper being ductile and porosity-free. As a result, the copper die cast rotor greatly enhances the performance and efficiency of the electrical induction motor which uses the rotor.

While the method and form of apparatus herein described constitutes a preferred embodiment of the invention, it is to be understood that the invention is not limited to the precise method and form of apparatus described, and that changes may be made therein without departing from the scope and spirit of the invention as defined in the appended claims.

The invention having thus been described, the following is claimed:

1. A method of producing a die-cast rotor for increasing the efficiency of an electric motor, comprising the steps of induction heating a predetermined volume of copper material including electrolytic copper and boron copper master alloy to a temperature of over 2,000° F. within a crucible until the material is in a molten state, transferring the crucible and the volume of molten copper material within the crucible to a die cast press including a charging cylinder enclosing a charging piston connected to a hydraulic cylinder, clamping end ring molds and a stack of rotor laminations against the charging cylinder, actuating the hydraulic cylinder to inject the molten copper material with the charging piston into corresponding cavities within the end ring molds and into peripherally spaced bar slots within the stack of rotor laminations, and cooling the molds to solidify the molten copper material within the cavities and slots.

2. A method as defined in claim 1 wherein the copper material comprises about 90% electrolytic copper and 10% boron copper.

3. A method as defined in claim 1 wherein the volume of copper material is induction heated and maintained in a molten state not more than ten minutes.

4. A method as defined in claim 1 wherein the molten copper material is injected into the end ring molds and bar slots at a flow rate of at least 1000 cubic inches per second and with a pressure of at least 2000 psi.

5. A method as defined in claim 1 and including the step of heat treating the die-cast copper rotor by heating the rotor to a temperature of about 1500° F. and then allow the rotor to cool slowly.

6. A method as defined in claim 1 wherein the molten copper material is injected into the mold cavity through gates at a velocity of at least 2000 inches per second.

7. A method of producing a die-cast rotor for increasing the efficiency of an electric motor, comprising the steps of induction heating a predetermined volume of copper material including electrolytic copper and boron copper alloy to a temperature of over 2,000° F. within a crucible until the material is in a molten state, transferring the crucible and the volume of molten copper material within the crucible to a vertical die cast press including a vertical charging cylinder enclosing a charging piston connected to a hydraulic cylinder, clamping end ring molds and a stack of rotor laminations downwardly against the charging cylinder, actuating the hydraulic cylinder to inject the molten copper material upwardly with the charging piston and through gates at a velocity of at least 2000 inches per second and into corresponding cavities within the end ring molds and into peripherally spaced bar slots within the stack of rotor laminations, and cooling the molds to solidify the molten copper material within the cavities and slots.

8. A method as defined in claim 7 wherein the copper material comprises about 90% electrolytic copper and 10% boron copper.

9. A method as defined in claim 7 wherein the volume of copper material is induction heated and maintained in a molten state not more than ten minutes.

10. A method as defined in claim 7 and including the step of heat treating the die-cast copper rotor by heating the rotor to a temperature of about 1500° F. and then allow the rotor to cool slowly.

11. A method of producing a die-cast rotor for increasing the efficiency of an electric motor, comprising the steps of induction heating a predetermined volume of copper material including electrolytic copper and boron copper master alloy to a temperature of over 2,000° F. within a crucible until the material is in a molten state, transferring the crucible and the volume of molten copper material within the crucible to a vertical die cast press including a charging cylinder enclosing a charging piston connected to a hydraulic cylinder, clamping end ring molds and a stack of rotor laminations downwardly against the charging cylinder, actuating the hydraulic cylinder to inject the molten copper material with the charging piston upwardly into corresponding cavities within the end ring molds and into peripherally spaced bar slots within the stack of rotor laminations at a flow rate of at least 1000 cubic inches per second, and cooling the molds to solidify the molten copper material within the cavities and slots.

12. A method as defined in claim 11 wherein the copper material comprises about 90% electrolytic copper and 10% boron copper.

13. A method as defined in claim 11 and including the step of heat treating the die-cast copper rotor by heating the rotor to a temperature of about 1500° F. and then allow the rotor to cool slowly.

14. Apparatus for producing a die-cast rotor for increasing the efficiency of an electric motor, comprising a crucible for receiving a predetermined volume of copper material, an induction heater for heating said crucible and the copper material therein to a temperature of over 2,000° F. until the material is in a molten state, a vertical die cast press including a vertical charging cylinder enclosing a charging piston connected to a hydraulic cylinder, means for transferring said crucible and the molten copper material within said crucible from said induction heater to said charging cylinder, a stack of rotor lamination defining peripherally spaced bar slots and positioned between a set of end ring molds defining corresponding cavities and gates connecting said cavities to said charging cylinder, means for clamping said set of end ring molds and rotor laminations downwardly against said charging cylinder, and means for actuating said hydraulic cylinder for moving said charging piston upwardly for injecting the molten copper material from said charging cylinder and through said gates at a velocity of at least 2000 inches per second and into said cavities and bar slots.

15. Apparatus as defined in claim 14 wherein said set of end ring molds comprises a molybdenum alloy material.

* * * * *